United States Patent [19]

Hibino et al.

[11] Patent Number: 4,502,833

[45] Date of Patent: Mar. 5, 1985

[54] MONITORING SYSTEM FOR SCREW COMPRESSOR

[75] Inventors: Yozo Hibino; Sakae Yamada, both of Ibaraki, Japan

[73] Assignee: Hitachi, Ltd., Tokyo, Japan

[21] Appl. No.: 434,554

[22] Filed: Oct. 15, 1982

[30] Foreign Application Priority Data

Oct. 21, 1981 [JP] Japan ..... 56-167191

[51] Int. Cl.[3] ..... F04D 49/00

[52] U.S. Cl. ..... 415/17; 415/47

[58] Field of Search ..... 415/16, 17, 26, 47, 415/51, 118; 374/141, 143

[56] References Cited

U.S. PATENT DOCUMENTS

| | | | |
|---|---|---|---|
| 3,441,200 | 4/1969 | Huesgen | 415/47 |
| 3,747,335 | 7/1973 | Strub | 415/17 |
| 4,156,578 | 5/1979 | Agar et al. | 415/17 |
| 4,384,818 | 5/1983 | Blotenberg | 415/17 |

FOREIGN PATENT DOCUMENTS

| | | | |
|---|---|---|---|
| 502131 | 5/1974 | U.S.S.R. | 415/17 |
| 47804 | 4/1978 | U.S.S.R. | 415/17 |
| 48002 | 2/1980 | U.S.S.R. | 415/47 |
| 48009 | 9/1980 | U.S.S.R. | 415/47 |

*Primary Examiner*—Henry C. Yuen
*Assistant Examiner*—John Kwon
*Attorney, Agent, or Firm*—Antonelli, Terry & Wands

[57] ABSTRACT

A monitoring system for a screw compressor for checking the operating conditions of the screw compressor by opening and closing a suction throttle valve located on the suction side of the screw compressor and an air discharge valve located on the discharge side thereof to thereby effect on-off control of the flow rate of the discharged air, wherein the operating conditions of components of the screw compressor are checked both in on-load and unloaded conditions by comparing values of the suction pressure, discharge pressure and discharged air temperature of the screw compressor with respective preset values.

14 Claims, 7 Drawing Figures

MONITORING SYSTEM FOR SCREW COMPRESSOR

BACKGROUND OF THE INVENTION

This invention relates to a monitoring system suitable for use in checking the operating conditions of a screw compressor.

In checking the operating conditions of a screw compressor, it has been usual practice to use a plurality of pressure switches and temperature switches for indicating the quantities of state of pressure and temperature prevailing in various parts of the screw compressor during operation and compare the results obtained with values set beforehand for the respective switches, to thereby indicate failures of the screw compressor by lighting corresponding lamps provided in a number equal to that of the switches.

Meanwhile, in a screw compressor, volume control is effected in various ways for adjusting the flow rate and pressure of the air discharged therefrom. Typical of such volume control are on-off control and suction throttle control. The former consists, as disclosed in Japanese Patent Laid-Open No. 124698/81, for example, in opening and closing a suction throttle valve located on the suction side of the screw compressor in accordance with a discharge pressure, and the latter consists in continuously throttling the suction throttle valve in accordance with a discharge pressure. Particularly in on-off control, there are great differences in the pressure and temperature of the compressed air between the open (on-load) condition of the suction throttle valve and the closed (unloaded) condition thereof. The volume of the compressed air undergoes a large variation immediately after the valve is opened and closed. This variation is not constant and may vary depending on the conditions of operation of the compressor and the conditions under which the compressor is used, so that quantities of state will be transiently obtained which are either very larger or smaller than those obtained in steady state operation. Thus, when the monitoring system of the prior art used for checking operating conditions of the screw compressor relies on comparison of the current values of quantities of state of pressure and temperature obtained by pressure and temperature switches with values set beforehand for the respective switches, it would be impossible to carry out diagnosis of the conditions of the screw compressor with a high degree of accuracy and precision. This is because of the fact that in this monitoring system it is impossible to provide malfunction sensing switches capable of functioning effectively by coping with both the on-load condition and the unloaded condition, so that it is necessary to render inoperative malfunction sensing switches in unloaded condition which are set to function in the on-load condition. This makes the monitoring system unable to check some quantities of state in unloaded condition. The reverse may be the case. Moreover, it is difficult to predict or measure accurately in what manner the quantities of state of a compressor will undergo changes in a transient state. Thus, it is necessary to render the malfunction sensing switches inoperative in the transient state or set the values for the switches in a manner to be set apart by a sufficiently large margin to avoid misoperation. Thus, the aforesaid type of monitoring system for checking the operation conditions of a screw compressor suffers the disadvantage that accurate diagnosis of the operating condition of the compressor cannot be made in both on-load and unloaded conditions.

An object of this invention is to provide a system capable of monitoring the operating conditions of a screw compressor in an appropriate fashion.

Another object is to provide a system capable of monitoring the operating conditions of a screw compressor thoroughly.

Still another object is to provide a monitoring system for checking the operating conditions of a screw compressor capable of producing results that are highly reliable.

To accomplish the aforesaid objects, the invention provides a monitoring system for checking the operating conditions of a screw compressor comprising a suction throttle valve located on the suction side of the screw compressor and an air discharge valve located on the discharge side thereof for effecting on-off control of the flow rate of the discharged fluid by opening and closing these valves, with the monitoring system comprising a first pressure sensor for sensing the suction pressure of the screw compressor; a second pressure sensor for sensing the discharge pressure of the screw compressor; a temperature sensor for sensing the temperature of compressed air on the discharge side of the screw compressor; diagnosing and judging means supplied thereto with on-load and unloaded operational signals for respectively judging the operating conditions of components of the screw compressor in the on-load and unloaded conditions by comparing signals produced by the sensors with preset values; and indicating means for indicating the judgement passed by the diagnosing and judging means.

Additional and other objects, features and advantages of the invention will become apparent from the description set forth hereinafter when considered in conjunction with the accompanying drawings.

DETAILED DESCRIPTION

Figure 1:
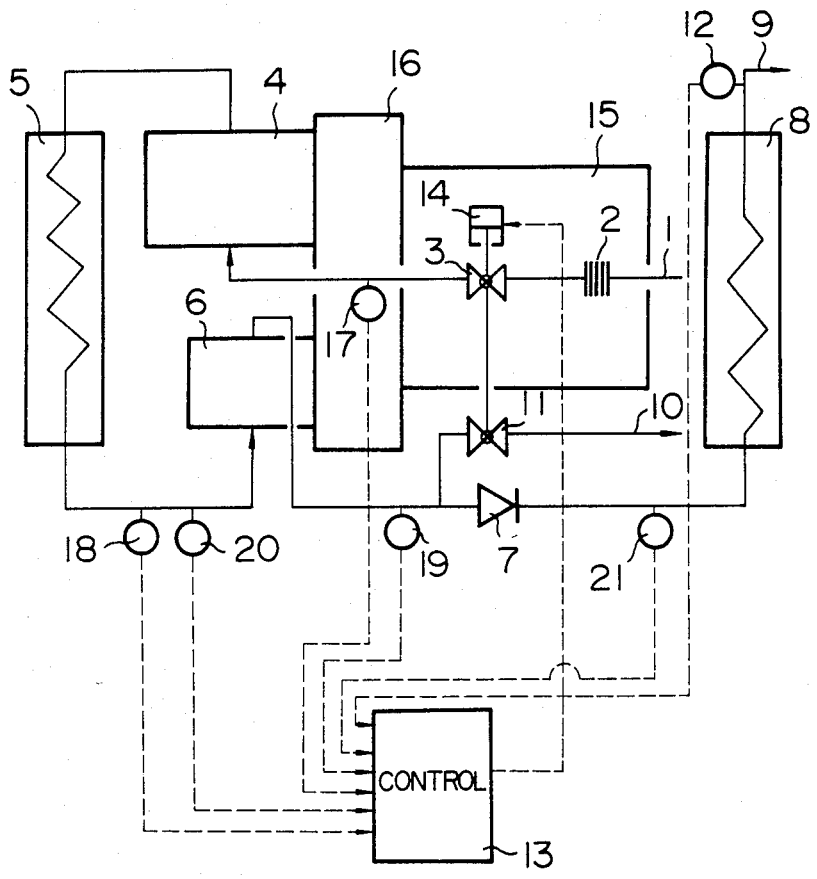
FIG. 1 is a schematic view of a screw compressor incorporating therein the monitoring system in accordance with an embodiment of the invention.

Referring now to the drawings wherein like reference numerals are used throughout the various views to designate like parts and, more particularly, to FIG. 1, according to this figure, with a screw compressor in an air compression system, air is drawn by suction through a suction port 1 and flows through a suction filter 2 and a suction throttle valve 3 into a first stage compressor 4 where it is compressed and then cooled by an intercooler 5. Then the air is compressed again in a second stage compressor 6 and flows through a check valve 7 to an after-cooler 8 where it is cooled before being discharged through a discharge port 9 from the compressor to be delivered to the next operating station. The flow rate and pressure of the air discharged through the discharge port 9 are adjusted by means of the suction throttle valve 3 for opening and closing the suction port 1 and an air discharge valve 11 for opening and closing an air releasing port 10. Volume control is effected by these valves in such a manner that a valve actuating signal is supplied based on a signal from a pressure sensor 12 for sensing the pressure of the discharged air, from a control 13 to a valve actuator 14, to actuate the valves 3 and 11 by the valve actuator 14.

When volume control is effected by on-off control in which the suction throttle valve 3 is opened and closed in accordance with a discharge pressure, the upper limit and the lower limit are set for the discharge pressure beforehand. Unloaded operation is performed by closing the suction throttle valve 3 and opening the air discharge valve 11 when the upper limit is reached and on-load operation is performed by opening the suction throttle valve 3 and closing the air discharge valve 11 when the lower limit is reached. The first and second screw compressors 4 and 6 are driven by a prime mover 15 and a speed increasing gear 16.

The most reliable method for checking the operating conditions of the screw compressors and determining whether or not the components thereof are in sound condition consists in sensing the pressure and temperature of the air along the air compression system for passing judgment. However, it would be disadvantageous to mount a large number of pressure and temperature sensors in various parts of the first and second stage compressors shown in FIG. 1 because the compressor would become expensive and reliability in performance might be reduced on account of the sensors themselves. In the invention, no more sensors than is necessary for monitoring the compressor operation are provided, and necessary sensors are mounted as follows. A pressure sensor 17 is mounted at an inlet of the first stage compressor 4; another pressure sensor 18 is mounted at an inlet of the second stage compressor 6; still another pressure sensor 19 is mounted at an outlet of the second stage compressor 6; a temperature sensor 20 is mounted at an inlet of the second stage compressor 6; and another temperature sensor 21 is mounted at an outlet of the check valve 7.

The control 13 is operative to check the operating conditions of the compressor and determine whether or not the components are sound, based on signals supplied by the sensors 17–21.

Figure 2:
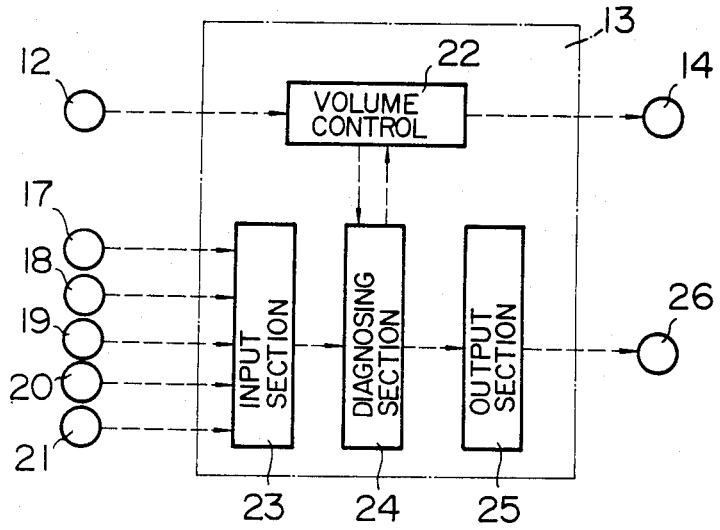
FIG. 2 is a block diagram of the monitoring system in accordance with embodiment of the invention.

As shown in FIG. 2, the control 13 includes a volume control 22, the aforesaid volume control function. 23 is an input section for receiving signals from the sensors 17–21, with a diagnosing section 24 having the main diagnosing function an output section 25 for supplying the results of the diagnosis, and an indicating section 26. The diagnosing section 24 is operative to receive signals of on-load and unloaded operations from the volume control 22 and to carry out diagnosis corresponding to the on-load and unloaded conditions to be subsequently described. The diagnosing section 24 has stored therein preset values to aid in giving diagnosis.

Figure 3:
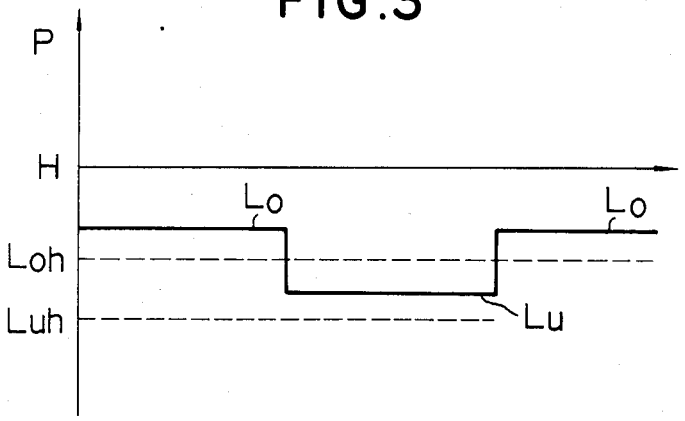
FIG. 3 is a time chart showing operations for sensing obturation of an opening of the suction throttle valve and obturation and malfunctioning of a filter in an unloaded condition.

FIG. 3 is a time chart showing changes in the air pressure P on the inlet side of the first stage compressor 4 in the aforesaid on-off control. The inlet air pressure P is sensed by the pressure sensor 17. In on-load condition Lo, a large quantity of air is drawn by suction into the compressor and the inlet air pressure P becomes slightly lower than the atmospheric pressure H. In unloaded condition Lu, the suction throttle valve 3 is closed and the inlet air pressure P drops substantially below the atmospheric pressure H. Thus, in unloaded condition, the suction throttle valve 3 is usually closed such that it is not brought to a full closed position and a small opening is left therein to allow a small quantity of air to be drawn therethrough to cool the compressor rotors. However, if the opening of the suction throttle valve 3 becomes smaller than the designed opening in size on account of foreign matter being deposited thereon, then overcompression results and causes trouble to the compressor. To avoid this danger, in unloaded condition Lu, a signal indicating the inlet air pressure P sensed by the pressure sensor 17 at this time is compared with a reference value Luh set beforehand, and adequate measures are taken, such as unloading the compressor system and shutting down the prime mover 15, when the inlet pressure P is lower than the reference value Luh. This is indicated by the indicating section 26. Also, in on-load condition, deposition of foreign matter on the suction filter 2 causes a reduction in suction pressure. Thus, in on-load condition, a signal indicating the inlet air pressure P sensed by the pressure sensor 17 is compared with a reference value Loh set beforehand, and adequate measures may be taken, such as unloading the compressor system and sounding the alarm, when the inlet pressure P is lower than the reference value Loh.

Figure 4:
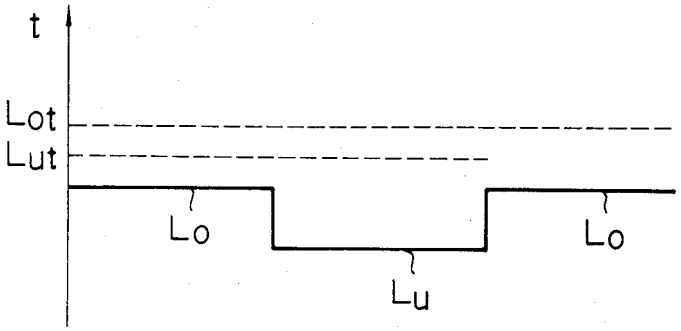
FIG. 4 is a time chart showing operations for sensing rotor contacting and cooling water cut-off in an on-load condition and misoperation of the check valve in an unloaded condition.

FIG. 4 is a time chart showing changes in the compressed air temperature t on the outlet side of the check valve 7 in the on-off control. The outlet temperature t of the check valve 7 is sensed by the temperature sensor 21. In on-load condition $L_o$, the check valve 7 is opened to allow the compressed air to flow therethrough, thereby raising the temperature. In unloaded condition $L_u$, the check valve 7 is closed and no rise in temperature t occurs. In on-load condition $L_o$, if the valve 3 is put out of order, rotor contacting occurs or supply of cooling water is cut off, then the compressed air shows a rise in temperature and causes trouble to the compressor. Thus, in on-load condition $L_o$, the temperature of the compressed air sensed by the temperature sensor 21 is compared with a preset reference value $L_{ot}$, and adequate measures are taken, such as unloading the compressor system or shutting down the prime mover 15, when the compressed air is higher than the reference value $L_{ot}$. This is indicated by the indicating section 26. In unloaded condition $L_u$, failure of the check valve 7 causes the temperature of the compressed air to rise because the compressed air flows through the malfunctioning check valve 7. Thus, in unloaded condition $L_u$, the temperature of the compressed air sensed by the temperature sensor 21 is compared with a preset reference value $L_{ut}$, and adequate measures may be taken, such as unloading the compression system and sounding the alarm, when the compressed air temperature is higher than the reference value $L_{ut}$.

Figure 5:
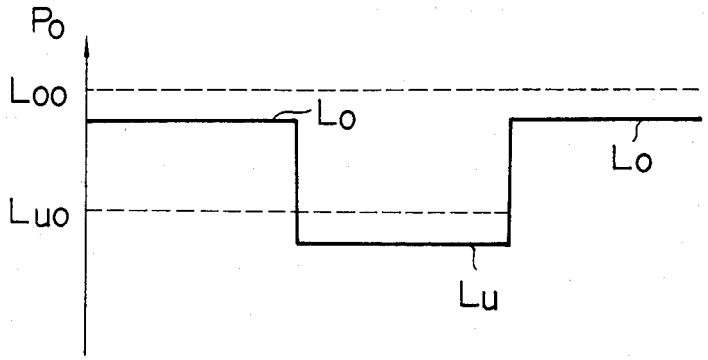
FIG. 5 is a time chart showing operations for sensing overcompression and valve failure in an unloaded condition and valve failure in an on-load condition.

FIG. 5 is a time chart showing changes in the compressed air pressure Po on the outlet side of the second stage compressor 6 in the on-off control. The outlet pressure Po of the second stage compressor 6 is sensed by the pressure sensor 19. In on-load condition Lo, the discharge pressure Po of the second stage compressor 6 rises. In unloaded condition Lu, the air discharge valve 11 is opened and the discharge pressure Po becomes near the atmospheric pressure. If overcompression occurs or the valves 7, 11 are out of order in unloaded condition Lu, then the discharge pressure Po rises. Thus, in unloaded condition Lu, the discharge pressure Po sensed by the pressure sensor 19 at this time and supplied as a signal thereby is compared with a preset reference value Luo as shown in FIG. 5, and adequate measures are taken, such as unloading the compressor system and shutting down the prime mover 15, when the discharge pressure Po is higher than the reference value Luo. This is indicated by the indicating section 26. The discharge pressure Po also rises in on-load condition Lo, when the values 11, 7 are out of order. Thus, in on-load condition Lo, the discharge pressure Po sensed by the pressure sensor 19 at this time is compared with a preset reference value Loo, and adequate measures may be taken, such as unloading the compressor system and shutting down the prime mover 15, when the discharge pressure Po is higher than the reference value Loo.

Figure 6:
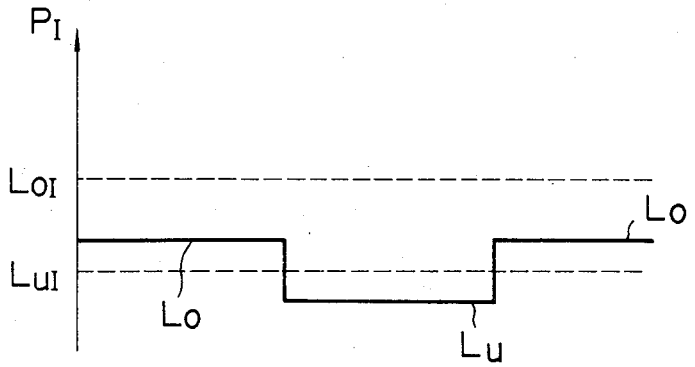
FIG. 6 is a time chart showing operations for sensing overcompression and valve failure in the on-load and unloaded conditions.

FIG. 6 is a time chart showing changes in the compressed air pressure $P_i$ on the inlet side of the second stage compressor 6 in the on-off control. The inlet pressure $P_i$ of the second stage compressor 6 is sensed by the pressure sensor 18. In on-load condition Lo, the inlet pressure $P_i$ of the second stage compressor 6 rises. In unloaded condition Lu, it drops because the suction throttle valve 3 is closed. Particularly in on-load condition, if overcompression occurs or the valves 3, 11 and 7 are put out of order, then the inlet pressure $P_i$ rises. Thus, in on-load condition Lo, the inlet pressure $P_i$ sensed by the pressure sensor 18 at this time and supplied as a preset signal is compared with a reference value $Lo_i$, as shown in FIG. 6, and adequate measures are taken, such as shutting down the prime mover 15 or unloading the compressor system, when the inlet pressure $P_i$ is higher than the reference value $Lo_I$. This is indicated by the indicating section 26. Also, in unloaded condition, the inlet pressure $P_i$ rises when overcompression occurs or the valves 3, 11 and 7 are put out of order. Thus, in unloaded condition Lu, the inlet pressure $P_i$ sensed by the pressure sensor 18 at this time and supplied as a signal is compared with a preset reference value $Lu_i$, and adequate measures are taken, such as unloading the compressor system and shutting down the prime mover 15, when the inlet pressure $P_i$ is higher than the reference value $Lu_I$. For the sake of convenience, the process used in on-load condition for passing judgement may also be used in unloaded condition.

Figure 7:
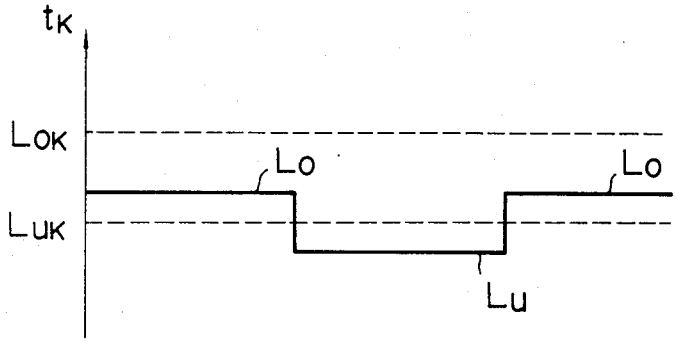
FIG. 7 is a time chart showing operations for sensing valve failure, rotor contacting and cooling water cut-off in the on-load and unloaded conditions.

FIG. 7 is a time chart showing changes in the compressed air temperature $t_k$ on the inlet side of the second stage compressor 6 in the on-off control. The inlet temperature $t_k$ of the second stage compressor 6 is sensed by the temperature sensor 20. In on-load condition $L_o$, the inlet temperature $t_k$ of the second stage compressor 6 rises. Also in unloaded condition $L_u$ it drops because the suction throttle valve 3 is closed. Particularly in on-load condition, if the valve 3 is put out of order, rotor contacting occurs or supply of cooling water is cut off, then the compressed air temperature rises and causes trouble to the compressor. Thus, in on-load condition Lo, the inlet temperature $t_k$ sensed by the temperature sensor 20 at this time and supplied as a signal is compared with a preset reference value $L_{ok}$ as shown in FIG. 7, and adequate measures are taken, such as unloading the compressor system or shutting down the time mover 15, when the inlet temperature $t_k$ is higher than the reference value $L_{ok}$. Also in unloaded condition, if the valve 3 is out of order, rotor contacts or supply of cooling water is cut off, then the inlet temperature $t_k$ rises. Thus, in unloaded condition $L_u$, the inlet temperature $t_k$ sensed by the temperature sensor 20 at this time and supplied as a signal is compared with a reference value $L_{uk}$ set beforehand and adequate measures may be taken, such as unloading the compressor system and shutting down the prime mover 15, when the inlet temperature $t_k$ is higher than the reference value $L_{uk}$. For the sake of convenience, the process used in on-load condition for passing judgment may also be used in unloaded condition.

The diagnosis based on the compressed air temperature t on the outlet side of the check valve 7 and the diagnosis based on the compressed air pressure $P_o$ on the outlet side of the second stage compressor 6 may be simplified by combining diagnosis based on the compressed air temperature t on the outlet side of the check valve 7 in on-load condition with diagnosis based on the outlet pressure $P_o$ of the second stage compressor 6 in unloaded condition. For the sake of convenience, the other diagnosis may also be combined.

The relationship between the operation of the suction throttle valve in the on-off control and the quantities of state of the compressor does not directly correspond to the operation of the suction throttle valve. That is, there is a momentary lag of the return of the discharge pressure and the discharge temperature of the compressor to steadystate conditions behind opening and closing of the suction throttle valve. Thus, the aforesaid diagnosis is preferably carried out when the compressor is in steadystate conditions. To this end, waiting time setting means may be provided between the volume control 22 and the diagnosing section 24 shown in FIG. 2 for causing on-load and unloaded signals supplied to the diagnosing section 24 to stand by until the compressor is returned to the steadystate conditions. Such waiting time setting means may comprise an on-load waiting time setter, an unloaded waiting time setter, an on-load waiting time counter for counting the set waiting time and producing a signal as an output, and an unloaded waiting time counter for counting the set waiting time and producing a signal as an output. Also the diagnosing section 24 may have connected thereto a setter for setting an interval between the time for carrying out diagnosis in the on-load condition and the time for carrying diagnosis in the unloaded conditions.

In the foregoing description, the operation of the system for monitoring the operating conditions of a screw compressor has been described by referring to the embodiment shown in block diagram in FIG. 2. As can be clearly seen from the description set forth hereinabove, the monitoring system may be realized by using relay circuits or a computer in accordance with the demand made on diagnosis.

From the foregoing description, it will be appreciated that the invention enables diagnosis of the operating conditions of a screw compressor to be carried out in a suitable manner. Thus, the diagnosis can be made by checking the operating conditions thoroughly and the judgement passed as a result is highly reliable. In addition, the system according to the invention is very low in cost.

What is claimed is:

1. A monitoring system for checking the operating conditions of a compressor system including a screw compressor means having an inlet and an outlet, a suction means having an upstream and downstream end connected to said inlet of said screw compressor means, an air discharge means having a downstream end and an upstream end connected to said outlet of said screw compressor means, an air releasing means having a downstream end and an upstream end connected to said air discharge duct at a location between said upstream and downstream airs of said air discharge means, a suction throttle valve provided in said suction means, an air discharge valve means for actuating said suction throttle valve and said air discharge valve to move them between an on-load condition in which said suction throttle valve is open and said air discharge valve is closed and an unloaded condition in which said suction throttle valve is substantially closed and said air discharge valve is open, discharge pressure sensing means associated with said air discharge means for sensing the discharge pressure of said screw compressor means and for generating a signal representative of the sensed discharge pressure, and volume control means means operative in response to the signal from said discharge pressure sensing means for controlling the operation of said actuating means to generate an on-load operating signal when said suction throttle valve and said air discharge valve are moved into said on-load condition and an unloaded operating signal when said suction throttle valve and said air discharge valve are moved into said unloaded condition, said monitoring system comprising:

suction pressure sensor means associated with said suction means for sensing the suction pressure of the screw compressor and for generating an output signal of the sensed pressure;

a temperature sensor means associated with said discharge means for sensing the temperature of compressed air passing through said air discharge means;

diagnosing and judging means operative in response to said on-load and unloaded operating signals from said volume control means for respectively judging the operating conditions of components of the screw compressor under the on-load and unloaded condition by comparing the values respectively sensed by said suction pressure sensor means and said temperature sensor means with respect to preset pressure and temperature values; and indicating means for indicating the judgment passed by said diagnosing and judging means.

2. A monitoring system as claimed in claim 1, wherein said suction pressure sensor means is provided in said suction means at a location downstream of said suction throttle valve and upstream of said inlet of said screw compressor means, and wherein said diagnosing and judging means includes a diagnosing section operative to compare, in the unloaded condition, the value sensed by said suction pressure sensor means with a corresponding one of said preset values and pass judgement, when the sensed value is lower than the preset value, that the opening of the suction throttle valve is clogged.

3. A monitoring system as claimed in claim 1, wherein said compressor system further comprises a suction filter provided in said suction means at a location upstream of said suction throttle valve, and wherein said diagnosing and judging means includes a diagnosing section operative to compare, in the on-load condition, the value sensed by said suction pressure sensor means with a corresponding one of said preset values and pass judgement, when the sensed value is higher than the preset value, that said suction filter is obturated.

4. A monitoring system as claimed in claim 1, wherein said compressor means comprises a first stage screw compressor and a second stage screw compressor, said compressor system further comprising an interconnecting means for interconnecting said first and second stage screw compressors for conducting the discharge pressure from said first stage screw compressor into said second stage screw compressor, and an intercooler associated with an interconnecting means for cooling the air passing therethrough, and wherein said monitoring system further comprises second temperature sensor means associated with said interconnecting means at a location downstream of said intercooler for sensing the temperature of air passing through said interconnecting means and generating a signal representative of the sensed temperature, and wherein said diagnosing and judging means includes a diagnosing section operative, in the on-load condition, to compare the values sensed by said second temperature sensor means with a corresponding one of said preset values and pass judgement, when the value sensed by said second temperature sensing means is higher than the preset value, that a rotor contact occurs in said first stage screw compressor and a supply of cooling water into said intercooler is cut off.

5. A monitoring system as claimed in claim 1, wherein said compressor system further comprises a check valve provided in said discharge means at a location downstream of the connection of said upstream end of said air releasing means to said air discharge means and upstream of a location where said discharge pressure sensing means is associated with said air discharge means, and wherein said monitoring system further comprises second temperature sensor means associated with said air discharge means at a location downstream of said check valve and upstream of said discharge pressure sensing means for sensing the temperature of air passing through said air discharge means and for generating a signal representative of the sensed temperature, said diagnosing and judging means including a diagnosing section operative to compare, in the unloaded condition, the values sensed by said second temperature sensor means with a corresponding one of said preset values and pass judgment, when the values sensed by said second temperature sensor means is higher than the preset value, that said check valve is malfunctioning.

6. A monitoring system as claimed in claim 1, wherein said compressor system further comprises a check valve provided in said discharge means at a location downstream of the connection of said upstream and of said air releasing means to said air discharge means and upstream of the location where said discharge pressure sensing means is associated with said air discharge means, and wherein said monitoring system further comprises second pressure sensor means associated with said air discharge means at a location downstream of said outlet of said compressor means and upstream of the connection of said upstream end of said air releasing means to said discharge means for sensing the pressure of air passing through siad air discharge means and for generating a signal representative of the sensed pressure, said diagnosing and judging means including a diagnosing section operative to compare, in the unloaded condition, the value sensed by said second pressure sensor means with a corresponding one of said preset values an pass judgment, when the value sensed by said second pressure means is higher than said preset value, that at least one of the air discharge valve and said check valve is malfunctioning.

7. A monitoring system as claimed in claim 1, wherein said compressor system further comprises a check valve provided in said discharge means at a location downstream of the connection of said upstream end of said air releasing means to said air discharge means and upstream of the location where said discharge pressure sensing means is associated with said air discharge means, and wherein said monitoring system further comprises second pressure sensor means associated with said air discharge means at a location downstream of said outlet of said compressor means and upstream of the connection of said upstream and of said air releasing means to said air discharge means for sensing the pressure of air passing through said air discharge means and for generating a signal representative of the sensed pressure, said diagnosing and judging means including a diagnosing section operative to compare, in the on-load condition, the value sensed by said second pressure sensor means with a corresponding one of said preset values and pass judgement, when the value sensed by said second pressure sensor means is higher than the preset value, that at least one of said air discharge valve and said check valve is malfunctioning.

8. A monitoring system as claimed in claim 1, wherein said compressor means comprises a first stage screw compressor and a second stage screw compressor, said compressor system further comprising an interconnecting means for interconnecting said first and second stage screw compressors for conducting a discharge pressure from said first stage screw compressor into said second stage screw compressor and a check valve provided in said air discharge means at a location downstream of the connection of said upstream end of said air releasing means to said air discharge means and upstream of a location where said discharge pressure sensing means is associated with said air discharge means, and wherein said monitoring system further comprises second pressure sensor means associated with said interconnecting means for sensing the pressure of air passing through said interconnecting means to generate a signal of the sensed pressure, said diagnosing and judging means including a diagnosing section operative to compare the values sensed by said second pressure sensor means with a corresponding one of said preset values and pass judgement, when the values sensed by said second pressure sensor means is higher than the preset value, that an overcompression occurs in the first stage screw compressor.

9. A monitoring system as claimed in claim 1, wherein said compressor means comprises a first stage screw compressor and a second stage screw compresor, said compressor system further comprising an interconnecting means for interconnecting said first and second stage screw compressors for conducting the discharge pressure from said first stage screw compressor into said second stage screw compressor and a check valve provided in said air discharge means at a location downwstream of the connection of said upstream end of said air releasing means to said air discharge means and upstream of a location where said discharge pressure sensing means is associated with said air discharge means, and wherein said monitoring system further comprises second pressure sensor means associated with said interconnecting means for sensing the pressure of air passing through said interconnecting means and for generating a signal representative of the sensed pressure, said diagnosing and judging means including a diagnosing section operative to compare the values sensed by said second pressure sensor means with a corresponding one of said preset values and pass judgement, when the values sensed by the second pressure sensor means is higher than the preset value, than at least one of the suction throttle valve, said air discharge valve, and said check valve is malfunctioning.

10. A monitoring system as claimed in any one of claims 2, 4, 6, 7, 8, or 9, wherein said diagnosing and judging means is operative to shut down a prime mover for driving said compressor means in dependence upon a judgement to unload said compressor system.

11. A monitoring system as claimed in one of claims 3 or 5, wherein said diagnosing and judging means is adapted to instruct said indicating means to unload said compressor system and to issue an alarm based on the judgement passed thereby.

12. A monitoring system for checking the operating conditions of a screw compressor comprising a suction throttle valve located on a suction side of the screw compressor and an air discharge valve located on the discharge side thereof for effecting on-off control of the flow rate of the discharged fluid by opening and closing said valves, said monitoring system comprising:

a first pressure sensor for sensing the suction pressure of the screw compressor;

a second pressure sensor for sensing the discharge pressure of the screw compressor;

a temperature sensor for sensing the temperature of compressed air on the discharge side of the screw compressor;

diagnosing and judging means supplied thereto with on-load and unloaded operating signals for respectively judging the operating conditions of components of the screw compressor in the on-load and unloaded condition by comparing signals produced by said sensors with preset values, said diagnosing and judging means is operative to compare, in the unloaded condition, a value sensed by said first pressure sensor with a corresponding one of said preset values and pass judgement, when the sensed value is lower than the preset value, that a trouble occurs at the opening of the suction throttle valve is clogged; and indicating means for indicating the judgement passed by said diagnosing and judging means.

13. A monitoring system as claimed in claim 12, wherein said diagnosing and judging means is operative to give, based on the judgement passed thereby, instructions to said indicating means to unload the compressor system and shut down a prime mover for driving the compressor.

14. A monitoring system for checking operation conditions of compressor system comprising a first stage screw compressor having an inlet and an outlet, a second stage screw compressor having an inlet and an outlet, a suction means having an upstream end and a downstream end connected to said inlet of said first stage screw compressor, an interconnecting means having an upstream end connected to said outlet of said first stage screw compressor and a downstream end connected to said inlet of said second stage screw compressor an air discharge means having an upstream end connected to said outlet of said second stage screw compressor and a downstream end, an air releasing means having a downstream end and an upstream end, connected to said air discharge means at a location between said upstream and downstream ends of said air discharge means, a suction filter provided in said suction means, a suction throttle valve provided in said suction means at a location downstream of said suction filter, an air discharge valve provided in said air releasing means, a check valve provided in said air discharge means at a location downstream of the connection of said upstream end of said air releasing means to said air discharge means, an after cooler associated with said air discharge means at a location downstream of said check valve for cooling air passing through said air discharge means, an intercooler associated with said interconnecting means for cooling air passing therethrough, actuating means operable for actuating said suction throttle valve and said air dischrge valve to move them between an on-load condition in which said suction throttle valve is opened and said air releasing valve is closed and an unloaded condition in which said suction throttle valve is substantially closed and said air releasing valve is opened, pressure sensing means associated with said air discharge means at a location downstream of said after cooler for sensing the discharge pressure of said second stage screw compressor and for generating a signal representative of the sensed discharged pressure, volume control means operative in response to the signal from said second pressure sensor means for controlling the operation of said actuating means and for generating an on-load operating signal when said suction throttle valve and said air discharge valve are moved into said on-load condition and an unloaded operating signal when said suction throttle valve and said air discharge valve are moved into said unloaded condition, said monitoring system comprising:

a first pressure sensor associated with said suction means for sensing the suction pressure of said first stage screw compressor;

a second pressure sensor associated with said interconnecting means at a location downstream of said intercooler for sensing the discharge pressure of said first stage screw compressor;

a third pressure sensor associated with said air discharge means at a location downstream of said outlet of said second screw compressor and upstream of the connection of said upstream end of said air releasing means to said discharge means for sensing the discharge pressure of said second stage screw compressor;

a first temperature sensor associated with said air discharge means at a location upstream of said after cooler for sensing the temperature of compressed air passing through said air discharge means;

a second temperature sensor associated with said interconnecting means at a location downstream of said intercooler for sensing the temperature of air discharged from said first stage screw compressor;

diagnosing and judging means operative in response to said on-load and unloaded operating signals from said volume control means for respectively judging the conditions of components of said screw compressor under the on-load and unloaded conditions by comparing values respectively sensed by said first, second and third pressure sensors and said first and second temperature sensors with respective preset values; and indicating means for indicating a judgement passed by said diagnosing and judging means.

* * * * *